US010573438B2

(12) United States Patent
Hirota et al.

(10) Patent No.: US 10,573,438 B2
(45) **Date of Patent: *Feb. 25, 2020**

(54) R-(FE, CO)-B SINTERED MAGNET AND MAKING METHOD

(71) Applicant: Shin-Etsu Chemical Co., Ltd., Tokyo (JP)

(72) Inventors: Koichi Hirota, Echizen (JP); Masayuki Kamata, Echizen (JP); Takahiro Hashimoto, Echizen (JP); Hajime Nakamura, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 439 days.

This patent is subject to a terminal disclaimer.

(21) Appl. No.: 15/350,327

(22) Filed: Nov. 14, 2016

(65) Prior Publication Data

US 2017/0140856 A1 May 18, 2017

(30) Foreign Application Priority Data

Nov. 18, 2015 (JP) ..... 2015-225300

(51) Int. Cl.
*H01F 1/057* (2006.01)
*B22F 3/24* (2006.01)
(Continued)

(52) U.S. Cl.
CPC ..... *H01F 1/0577* (2013.01); *B22F 3/16* (2013.01); *B22F 3/24* (2013.01); *C22C 38/001* (2013.01);
(Continued)

(58) Field of Classification Search
None
See application file for complete search history.

(56) References Cited

U.S. PATENT DOCUMENTS 7,090,730 B2 8/2006 Nomura et al.
9,892,831 B2 * 2/2018 Hirota ..... H01F 41/0266
(Continued)

FOREIGN PATENT DOCUMENTS

| | | | |
|---|---|---|---|
| CN | 106024252 | A | 10/2016 |
| EP | 1214720 | A1 | 6/2002 |
| EP | 1420418 | A1 | 5/2004 |
| JP | 2003-510467 | A | 3/2003 |
| JP | 3997413 | B2 | 10/2007 |
| JP | 2014-132628 | A | 7/2014 |
| JP | 2014-146788 | A | 8/2014 |
| JP | 5572673 | B2 | 8/2014 |

(Continued)

OTHER PUBLICATIONS

Office Action dated Aug. 20, 2019, issued in counterpart CN Application No. 201611027396.4, with English translation (33 pages).

*Primary Examiner* — Xiaowei Su
(74) *Attorney, Agent, or Firm* — Westerman, Hattori, Daniels & Adrian, LLP

(57) ABSTRACT

An R—(Fe,Co)—B base sintered magnet consisting essentially of 12-17 at % of R containing Nd and Pr, 0.1-3 at % of $M_1$ (typically Si), 0.05-0.5 at % of $M_2$ (typically Ti), B, and the balance of Fe, and containing $R_2(Fe,Co)_{14}B$ as a main phase has a coercivity of at least 10 kOe. The magnet contains a $M_2$ boride phase at a grain boundary triple junction, and has a core/shell structure that the main phase is covered with a grain boundary phase. The grain boundary phase is composed of an amorphous and/or nanocrystalline R'—(Fe,Co)—$M_1$' phase consisting essentially of 25-35 at % of R' containing Pr, 2-8 at % of $M_1$' (typically Si), up to 8 at % of Co, and the balance of Fe. A coverage of the main phase with the R'—(Fe,Co)—$M_1$' phase is at least 50%, and the bi-granular grain boundary phase has a width of at least 50 nm.

9 Claims, 2 Drawing Sheets

(51) Int. Cl.

| | |
|---|---|
| ***H01F 41/02*** | (2006.01) |
| ***B22F 3/16*** | (2006.01) |
| ***C22C 38/00*** | (2006.01) |
| ***C22C 38/02*** | (2006.01) |
| ***C22C 38/06*** | (2006.01) |
| ***C22C 38/10*** | (2006.01) |
| ***C22C 38/14*** | (2006.01) |
| ***C22C 38/16*** | (2006.01) |

(52) U.S. Cl.

CPC ..... *C22C 38/002* (2013.01); *C22C 38/005* (2013.01); *C22C 38/008* (2013.01); *C22C 38/02* (2013.01); *C22C 38/06* (2013.01); *C22C 38/10* (2013.01); *C22C 38/14* (2013.01); *C22C 38/16* (2013.01); *H01F 41/0266* (2013.01); *B22F 2003/248* (2013.01)

(56) References Cited

U.S. PATENT DOCUMENTS

| | | | | |
|---|---|---|---|---|
| 2013/0271248 | A1* | 10/2013 | Nagata | H01F 1/0311 335/302 |
| 2014/0132377 | A1 | 5/2014 | Nakajima et al. | |
| 2014/0191831 | A1 | 7/2014 | Yamazaki et al. | |
| 2014/0290803 | A1* | 10/2014 | Kato | H01F 1/0577 148/302 |
| 2016/0293303 | A1 | 10/2016 | Hirota et al. | |

FOREIGN PATENT DOCUMENTS

| | | | |
|---|---|---|---|
| JP | 2014-209546 | A | 11/2014 |
| WO | 2014/157448 | A1 | 10/2014 |
| WO | 2014/157451 | A1 | 10/2014 |

* cited by examiner

EXAMPLE 1

BACK-SCATTERING ELECTRON IMAGE

Pr/(TRE)

R-(FE, CO)-B SINTERED MAGNET AND MAKING METHOD

CROSS-REFERENCE TO RELATED APPLICATION

This non-provisional application claims priority under 35 U.S.C. § 119(a) on Patent Application No. 2015-225300 filed in Japan on Nov. 18, 2015, the entire contents of which are hereby incorporated by reference.

TECHNICAL FIELD

This invention relates to an R—(Fe,Co)—B base sintered magnet having a high coercivity at high temperature and a method for preparing the same.

BACKGROUND ART

While Nd—Fe—B sintered magnets, referred to as Nd magnets, hereinafter, are regarded as the functional material necessary for energy saving and performance improvement, their application range and production volume are expanding every year. Since many applications encounter a hot environment, the Nd magnets incorporated therein must have heat resistance as well as a high remanence. On the other hand, since the coercivity of Nd magnets are easy to decrease significantly at a elevated temperature, the coercivity at room temperature must be increased enough to maintain a certain coercivity at a working temperature.

As the means for increasing the coercivity of Nd magnets, it is effective to substitute Dy or Tb for part of Nd in $Nd_2Fe_{14}B$ compound as main phase. For these elements, there are short resource reserves in the world, the commercial mining areas in operation are limited, and geopolitical risks are involved. These factors indicate the risk that the price is unstable or largely fluctuates. Under the circumstances, the development for a new process and a new composition of R—(Fe,Co)—B magnets with a high coercivity, which include a minimizing the content of Dy and Tb, is required.

From this standpoint, several methods are already proposed. Patent Document 1 discloses an R—(Fe,Co)—B base sintered magnet having a composition of 12-17 at % of R (wherein R stands for at least two of yttrium and rare earth elements and essentially contains Nd and Pr), 0.1-3 at % of Si, 5-5.9 at % of B, 0-10 at % of Co, and the balance of Fe (with the proviso that up to 3 at % of Fe may be substituted by at least one element selected from among Al, Ti, V, Cr, Mn, Ni, Cu, Zn, Ga, Ge, Zr, Nb, Mo, In, Sn, Sb, Hi, Ta, W, Pt, Au, Hg, Pb, and Bi), containing a $R_2(Fe,(Co),Si)_{14}B$ intermetallic compound as main phase, and exhibiting a coercivity of at least 10 kOe. Further, the magnet is free of a B-rich phase and contains at least 1 vol % based on the entire magnet of an R—Fe(Co)—Si grain boundary phase consisting essentially of 25-35 at % of R, 2-8 at % of Si, up to 8 at % of Co, and the balance of Fe. During sintering or post-sintering heat treatment, the sintered magnet is cooled at a rate of 0.1 to 5° C./min at least in a temperature range from 700° C. to 500° C. or cooled in multiple stages including holding at a certain temperature for at least 30 minutes on the way of cooling, for thereby generating the R—Fe(Co)—Si grain boundary phase in grain boundary.

Patent Document 2 discloses a Nd—Fe—B alloy with a low boron content. A permanent magnet is prepared from this alloy by sintering a starting material and cooling the sintered product below 300° C. The step of cooling down to 800° C. is at an average cooling rate $\Delta T1/\Delta t1<5K/min$.

Patent Document 3 discloses an R-T-B magnet comprising a main phase composed mainly of $R_2Fe_{14}B$ and a grain boundary phase containing more R than the main phase, the grain boundary phase containing a grain boundary phase having a high rare earth concentration (R-rich phase) and a grain boundary phase having a low rare earth concentration and a high transition metal concentration (transition metal-rich phase). The R-T-B rare earth sintered magnet is prepared by sintering at 800 to 1,200° C. and heat treatment at 400 to 800° C.

Patent Document 4 discloses an R-T-B rare earth sintered magnet comprising a grain boundary phase containing an R-rich phase having a total atomic concentration of rare earth elements of at least 70 at % and a ferromagnetic transition metal-rich phase having a total atomic concentration of rare earth elements of 25 to 35 at %, wherein an area proportion of the transition metal-rich phase is at least 40% of the grain boundary phase. The sintered magnet is prepared by shaping an alloy material into a compact, sintering the compact at 800 to 1,200° C., first heat treatment of heating at a temperature which is in the range of 650 to 900° C. and lower than the decomposition temperature of the transition metal-rich phase, cooling to 200° C. or below, and second heat treatment of heating at 450 to 600° C.

Patent Document 5 discloses an R-T-B rare earth sintered magnet in the form of a sintered body comprising a main phase of $R_2Fe_{14}B$ and a grain boundary phase containing more R than the main phase, wherein the main phase has a magnetization direction in c-axis direction, crystal grains of the main phase are of elliptic shape elongated in a direction transverse to the c-axis direction, and the grain boundary phase contains an R-rich phase having a total atomic concentration of rare earth elements of at least 70 at % and a transition metal-rich phase having a total atomic concentration of rare earth elements of 25 to 35 at %. Also described are sintering at 800 to 1,200° C. and subsequent heat treatment at 400 to 800° C. in an argon atmosphere.

Patent Document 6 discloses a rare earth magnet comprising $R_2T_{14}B$ main phase crystal grains and an intergranular grain boundary phase between two adjacent $R_2T_{14}B$ main phase crystal grains, wherein the intergranular grain boundary phase has a thickness of 5 nm to 500 nm and is composed of a phase having different magnetism from ferromagnetism. It is described that the intergranular grain boundary phase further contains element T and an element which will form a non-ferromagnetic compound. For this purpose, element M such as Al, Ge, Si, Sn or Ga is preferably added. By adding these elements to the rare earth magnet in addition to Cu, a crystalline phase with a $La_6Co_{11}Ga_3$-type crystal structure having a good crystallinity may be evenly and broadly formed as the intergranular grain boundary phase, and a thin R—Cu layer may be formed at the interface between the $La_6Co_{11}Ga_3$-type intergranular grain boundary phase and the $R_2T_{14}B$ main phase crystal grains. As a result, the interface of the main phase is passivated, a lattice distortion of main phase can be suppressed, and nucleation of the magnetic reversal domain can be inhibited. The method of preparing the magnet involves sintering, heat treatment at a temperature in the range of 500 to 900° C. and cooling at a cooling rate which is preferably at least 100° C./min, especially at least 300° C./min.

Patent Document 7 and 8 disclose an R-T-B sintered magnet comprising a main phase of $Nd_2Fe_{14}B$ compound, an intergranular grain boundary which is enclosed between two main phase grains and which has a thickness of 5 nm to 30 nm, and a grain boundary triple junction which is the phase surrounded by three or more main phase grains.

CITATION LIST

Patent Document 1: JP 3997413 (U.S. Pat. No. 7,090,730, EP 1420418)
Patent Document 2: JP-A 2003-510467 (EP 1214720)
Patent Document 3: JP 5572673 (US 20140132377)
Patent Document 4: JP-A 2014-132628
Patent Document 5: JP-A 2014-146788 (US 20140191831)
Patent Document 6: JP-A 2014-209546 (US 20140290803)
Patent Document 7: WO 2014/157448
Patent Document 8: WO 2014/157451

DISCLOSURE OF INVENTION

However, there exists a need for an R—(Fe,Co)—B sintered magnet which exhibits a high coercivity at high temperature although the content of Dy and Tb is minimal or nil.

An object of the invention is to provide an R—(Fe,Co)—B sintered magnet exhibiting a high coercivity both at room temperature and at high temperature, and a method for preparing the same.

The inventors have found that a desired R—(Fe,Co)—B base sintered magnet can be prepared by a method comprising the steps of shaping a magnet-forming alloy powder into a compact, sintering the compact, cooling the resulting magnet to a temperature of 400° C. or below, high-temperature heat treatment including heating the magnet at a temperature in the range of 700 to 1,000° C. and not lower than the decomposition temperature ($T_d$° C.) of a compound consisting of the same components as an R'—(Fe,Co)—$M_1$' phase containing at least 5 at % of Pr, and cooling to a temperature of 400° C. or below at a rate of 5 to 100° C./min, and low-temperature heat treatment including holding at a temperature in the range of 400 to 600° C. and not higher than Td° C. for 1 minute to 20 hours, for allowing at least 80% by volume of the R'—(Fe,Co)—$M_1$' phase to precipitate in the magnet, and cooling to a temperature of 200° C. or below, or cooling the resulting magnet to a temperature of 400° C. or below at a rate of 5 to 100° C./min, and low-temperature heat treatment including holding at a temperature in the range of 400 to 600° C. and not higher than Td° C. for 1 minute to 20 hours, for allowing at least 80% by volume of the R'—(Fe,Co)—$M_1$' phase to precipitate in the magnet, and cooling to a temperature of 200° C. or below. The magnet contains $R_2(Fe,Co)_{14}B$ intermetallic compound as a main phase and a $M_2$ boride phase at a grain boundary triple junction, but not $R_{1.1}Fe_4B_4$ compound phase, and has a core/shell structure that at least 50% by volume of the main phase is covered with a R'—(Fe,Co)—M' phase having a width of at least 50 nm on the average, and the magnet has a coercivity of at least 10 kOe. This sintered magnet maintains a high coercivity even at high temperature, and has heat resistance. Continuing experiments to establish appropriate processing conditions and an optimum magnet composition, the inventors have completed the invention.

It is noted that Patent Document 1 recites a low cooling rate after sintering. Even if R—(Fe,Co)—Si grain boundary phase forms a grain boundary triple junction, in fact, the main phase or form an intergranular grain boundary phase between adjacent main phase grains. Because of a yet low cooling rate, Patent Document 2 fails to establish the structure that the main phase is covered with the R—(Fe,Co)—M grain boundary phase. Patent Document 3 refers nowhere to the cooling rate after sintering and after heat treatment, and the description of the structure suggests that an intergranular grain boundary phase is not formed. The magnet of Patent Document 4 has a grain boundary phase containing R-rich phase and transition metal-rich phase with 25 to 35 at % R which is a ferromagnetic phase, whereas the R—(Fe,Co)—M phase of the inventive magnet is an antiferromagnetic phase rather than ferromagnetic phase. The first heat treatment in Patent Document 4 is carried out below the decomposition temperature of R—(Fe,Co)—M phase, whereas the high-temperature heat treatment in the invention is carried out above the decomposition temperature of R—Fe(Co)—M phase.

Patent Document 5 describes that sintering is followed by heat treatment at 400 to 800° C. in an argon atmosphere, but refers nowhere to the cooling rate. The description of the structure suggests the lack of the structure that the main phase is covered with the R—(Fe,Co)—M phase. In Patent Document 6, the cooling rate after heat treatment is preferably at least 100° C./min, especially at least 300° C./min. The grain boundary phase in the resulting magnet contains $R_6T_{13}M_1$ phase which is crystalline and R—Cu phase which is amorphous or nanocrystalline. In the inventive magnet, R—(Fe,Co)—M phase is amorphous or nanocrystalline.

Patent Document 7 has the problem that the thickness (phase width) of first grain boundary is too small to achieve a sufficient improvement in coercivity. Patent Document 8 describes in Example section substantially the same method for preparing sintered magnet as Patent Document 7, suggesting that the thickness (phase width) of first grain boundary is small.

None of the Cited patent documents refer to the content of Pr in R—(Fe,Co)—M phase and heat resistance.

In one aspect, the invention provides an R—(Fe,Co)—B base sintered magnet of a composition consisting essentially of 12 to 17 at % of R which is at least two of yttrium and rare earth elements and essentially contains Nd and Pr, 0.1 to 3 at % of $M_1$ which is at least one element selected from the group consisting of Si, Al, Mn, Ni, Cu, Zn. Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta, and W, 4.8+2×m to 5.9+2×m at % of B wherein a is at % of $M_2$, up to 10 at % of Co, up to 0.5 at % of carbon, up to 1.5 at % of oxygen, up to 0.5 at % of nitrogen, and the balance of Fe. The magnet contains $R_2(Fe,Co)_{14}B$ intermetallic compound as a main phase, and has a coercivity of at least 10 kOe at room temperature. The magnet contains a N boride phase at a grain boundary triple junction, but not $R_{1.1}Fe_4B_4$ compound phase, has a core/shell structure that the main phase is covered with a grain boundary phase. The grain boundary phase is composed of an amorphous and/or nanocrystalline R'—(Fe,Co)—$M_1$' phase consisting essentially of 25 to 35 at % of R' which consists of at least 5 at % of Pr and the balance of Nd and at least one of yttrium and rare earth elements, and contents of Pr in R' is higher than that of $R_2(Fe,Co)_{14}B$ intermetallic compound as a main phase, 2 to 8 at % of $M_1$' wherein $M_1$' is at least one element selected from the group consisting of Si, Al, Mn, Ni, Cu, en, Ga, Ge, Pd, Ag, Cd, In, Sn, Sb, Pt, Au, Hg, Pb, and Bi, up to 8 at % of Co, and the balance of Fe, or the R'—(Fe,Co)—$M_1$' phase and an amorphous and/or nanocrystalline R'—$M_1$" phase containing at least 50 at % of R' wherein $M_1$" is at least one element selected from the group consisting of Si, Al, Mn, Ni, Cu, Zn, Ga, Ge, Pd, Ag, Cd, In, Sn, Sb, Pt, Au, Hg, Pb, and Bi. A coverage of the main phase with the R'—(Fe,Co)—$M_1$' phase is at least 50% by volume. The width of the grain boundary phase between two main phase grains is at least 50 nm on the average.

Preferably, in the R'—(Fe,Co)—$M_1$' phase, $M_1$' consists of 0.5 to 50 at % of Si and the balance of at least one element selected from the group consisting of Al, Mn, Ni, Cu, Zn, Ga, Ge, Pd, Ag, Cd, In, Sn, Sb, Pt, Au. Hg, Pb, and Bi; $M_1$' consists of 1.0 to 80 at % of Ga and the balance of at least one element selected from the group consisting of Si, Al, Mn, Ni, Cu, Zn, Ge, Pd, Ag, Cd, In, Sn, Sb, Pt. Au, Hg, Pb, and Bi; $M_1$' consists of 0.5 to 50 at % of Al and the balance of at least one element selected from the group consisting of Si, Mn, Ni, Cu, Zn, Ga, Ge, Pd, Ag, Cd, In, Sn, Sb, Pt, Au, Hg, Pb, and Bi; or $M_1$' consists of 0.5 to 50 at % of Cu and the balance of at least one element selected from the group consisting of Si, Al, Mn, Ni, Zn, Ga, Ge, Pd. Ag, Cd, In, Sn, Sb, Pt, Au, Hg, Pb, and Bi.

In a preferred embodiment, a total content of Dy and Tb is 0 to 5.0 at %.

In another aspect, the invention provides a method for preparing the R—(Fe,Co)—B base sintered magnet defined herein, comprising the steps of shaping a magnet-forming alloy powder into a compact, the alloy powder being obtained by finely milling an alloy consisting essentially of 12 to 17 at % of R which is at least two of yttrium and rare earth elements and essentially contains Nd and Pr, 0.1 to 3 at % of $M_1$ which is at least one element selected from the group consisting of Si, Al, Mn, Ni, Cu, Zn, Ga, Ge. Pd, Ag, Cd, In, Sn, Sb, Pt. Au, Hg, Pb, and Bi, 0.05 to 0.5 at % of $M_2$ which is at least one element selected from the group consisting of Ti, V, Cr, Zr, Nb, Mo, Hf, Ta and W, 4.8+2×m to 5.9+2×m at % of B wherein m is at % of $M_2$, up to 10 at % of Co, and the balance of Fe, and having an average particle size of up to 5.0 μm; sintering the compact at a temperature of 1,000 to 1,150° C.; cooling the resulting magnet to a temperature of 400° C. or below; high-temperature heat treatment including heating the magnet at a temperature in the range of 700 to 1,000° C. and not lower than the decomposition temperature ($T_d$° C.) of a compound consisting of the same components as the R'—(Fe,Co)—$M_1$' phase, and cooling to a temperature of 400° C. or below at a rate of 5 to 100° C./min and low-temperature heat treatment including holding at a temperature in the range of 400 to 600° C. and not higher than Td° C. for 1 minute to 20 hours, for allowing at least 80% by volume of the R'—(Fe,Co)—$M_1$' phase to precipitate in the magnet, and cooling to a temperature of 200° C. or below.

In a further aspect, the invention provides a method for preparing the R—(Fe,Co)—B base sintered magnet defined herein, comprising the steps of shaping a magnet-forming alloy powder (same as above) into a compact; sintering the compact at a temperature of 1,000 to 1,150° C.; cooling the resulting magnet to a temperature of 400° C. or below at a rate of 5 to 100° C./min and low-temperature heat treatment including holding at a temperature in the range of 400 to 600° C. and not higher than Td° C. for 1 minute to 20 hours, for allowing at least 80% by volume of the R'—(Fe,Co)—$N_1$' phase to precipitate in the magnet, and cooling to a temperature of 200° C. or below.

In a preferred embodiment, the alloy contains Dy and/or Tb in a total amount of 0 to 5.0 at %.

Advantageous Effects of Invention

The R—(Fe,Co)—B base sintered magnet of the invention exhibits a coercivity of at least 10 kOe despite a low or nil content of Dy and Tb.

DESCRIPTION OF PREFERRED EMBODIMENTS

Figure 1:
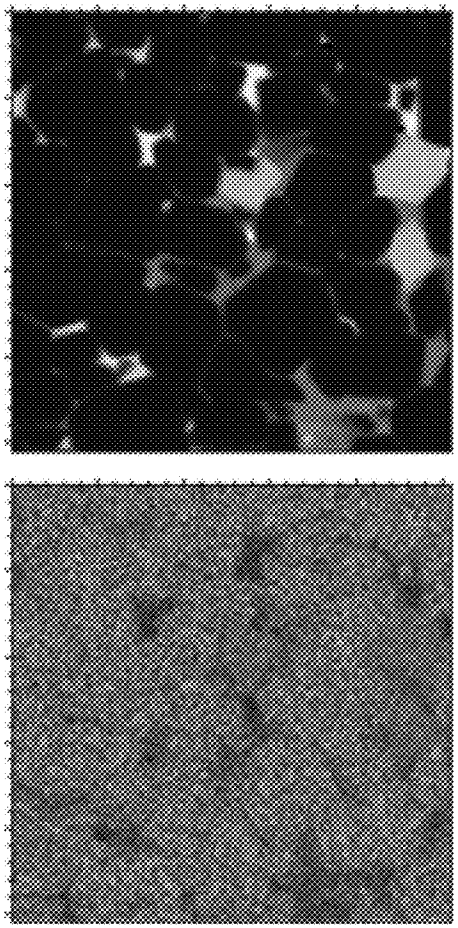
FIG. 1 is a set of images (×3000) in cross section of sintered magnets in Example 1, observed under electron probe microanalyzer (EPMA).

First, the composition of the R—(Fe,Co)—B sintered magnet is described. The magnet has a composition (expressed in atomic percent) consisting essentially of 12 to 17 at %, preferably 13 to 16 at % of R, 0.1 to 3 at %, preferably 0.5 to 2.5 at % of $M_1$, 0.05 to 0.5 at %, preferably 0.07 to 0.4 at % of $M_2$, 4.8+2×m to 5.9+2×m at %, preferably 4.9+2×m to 5.7+2×m at % of B wherein m is at % of $M_2$, up to 10 at % of Co, and the balance of Fe.

Herein, R is at least two of yttrium and rare earth elements and essentially contains neodymium (Nd) and praseodymium (Pr). Preferably Nd and Pr in total account for 80 to 100 at % of R. When the content of R is less than 12 at %, the magnet has an extremely reduced coercivity. When the content of R is more than 17 at %, the magnet has a low remanence (residual magnetic flux density) Br. It is noted that R may not contain Dy and Tb. When Dy and/or Tb is contained, the total content of Dy and Tb is preferably up to 5.0 at % (i.e., 0 to 5.0 at %), more preferably up to 2.0 at % (i.e., 0 to 2.0 at %), and even more preferably up to 1.5 at % (i.e., 0 to 1.5 at %), based on the magnet composition.

$M_1$ is at least one element selected from the group consisting of Si, Al, Mn, Ni, Cu. Zn, Ga, Ge. Pd, Ag, Cd, In, Sn, Sb, Pt, Au, Hg, Pb, and Bi. M is added as the element to constitute R'—(Fe,Co)—$M_1$' and R'—$M_1$" phases. When the content of $M_1$ is less than 0.1 at %, the R'—(Fe,Co)—$M_1$' phase forms in the sintered magnet in an insufficient amount to cover the $R_2(Fe,Co)_{14}B$ phase as the main phase, with squareness being degraded, and the width of the grain boundary phase is reduced, failing to exert the desired effect of improving coercivity. When the content of $M_1$ exceeds 3 at %, the magnet has a low remanence Br.

$M_2$ is at least one element selected from the group consisting of Ti, V, Cr, Zr, Nb, Mo, Hf, Ta and W. $M_2$ is added as the element capable of forming a thermodynamically more stable boride (e.g., $TiB_2$, $ZrB_2$ or $NbB_2$) than the $R_2(Fe,Co)_{14}B$ phase as the main phase in the sintered magnet. The boride forms at a grain boundary triple junction in the sintered magnet and is effective for inhibiting abnormal grain growth of main phase grains during sintering. The effect of restraining any degradation of squareness by abnormal grain growth is expectable. The magnet composition with a boron (B) content in the range defined herein has a tendency that primary crystals of α-Fe are left in excess in the starting alloy and as a result, the squareness of the sintered magnet is degraded. The addition of $M_2$ is effective for suppressing precipitation of α-Fe phase and hence, for improving the squareness of the sintered magnet. When the content of $M_2$ is less than 0.05 at %, boride forms in the sintered magnet in an insufficient amount to exert the effect of improving squareness. When the content of $M_2$ exceeds 0.5 at %, remanence Br is reduced.

The boron (B) content ranges from (4.8+2×m) at % to (5.9+2×m) at %. If the boron (B) content exceeds (5.9+2×m) at % wherein m is at % of $M_2$, the R'—(Fe,Co)—$M_1$' phase does not form, with a decline of coercivity. If the boron (B) content is less than (4.8+2×m) at %, remanence Br is significantly reduced.

Cobalt (Co) is optional. For the purpose of improving Curie temperature and corrosion resistance, Co may substitute for up to 10 at %, preferably up to 5 at % of Fe. Co substitution in excess of 10 at % is undesirable because of a substantial loss of coercivity.

For the inventive magnet, the contents of oxygen, carbon and nitrogen are desirably as low as possible. The magnet preparation process accompanies inevitable introduction of such elements. An oxygen content of up to 1.5 at %, especially up to 1.2 at %, a carbon content of up to 0.5 at %, especially up to 0.4 at %, and a nitrogen content of up to 0.5 at %, especially up to 0.3 at % are permissible. The inclusion of up to 0.1 at % of other elements such as H, F, Mg, P, S, Cl and Ca as the impurity is permissible, and the content thereof is desirably as low as possible.

The balance is iron (Fe). The Fe content is preferably 70 to 80 at %, more preferably 75 to 80 at %.

The structure of the magnet contains $R_2(Fe,Co)_{14}B$ phase as a main phase and a grain boundary phase. The grain boundary phase is composed of an amorphous and/or nanocrystalline R'—(Fe,Co)—$M_1$' phase consisting essentially of 25 to 35 at % of R' which consists of at least 5 at % of Pr and the balance of Nd and at least one of yttrium and rare earth elements, and contents of Pr in R' is higher than that of $R_2(Fe,Co)_{14}B$ intermetallic compound as a main phase, 2 to 8 at % of $M_1$' wherein $M_1$' is at least one element selected from the group consisting of Si, Al, Mn, Ni, Cu, Zn, Ga, Ge, Pd, Ag, Cd, In, Sn, Sb. Pt, Au, Hg, Pb, and Bi, up to 8 at % of Co, and the balance of Fe, or the R'—(Fe,Co)—$M_1$' phase and an amorphous and/or nanocrystalline R'—$M_1$" phase containing at least 50 at % of R' wherein $M_1$" is at least one element selected from the group consisting of Si, Al, Mn, Ni, Cu, Sn, Ga, Ge, Pd, Ag, Cd, In, Sn, Sb, Pt, Au, Hg. Pb, and Bi. At the grain boundary triple junction, there are formed an R oxide phase, R carbide phase, R nitride phase, or R oxyfluoride phase of high-melting compound or a mixture of such phases and $M_2$ boride phase (e.g., $TiB_2$, $ZrB_2$ or $NbB_2$). On the other hand, $R_2(Fe,Co)_{17}$ phase and $R_{1.1}Fe_4B_4$ compound phase are absent.

The R'—(Fe,Co)—$M_1$' grain boundary phase is a compound containing Fe or Fe and Co, and considered as an intermetallic compound phase having a crystal structure of space group I4/mcm, for example, $R_6Fe_{13}Ga_1$. On quantitative analysis by an analytic technique such as electron probe microanalyzer (EPMA), this phase consists of 25 to 35 at % of R', 2 to 8 at % of $M_1$', 0 to 8 at % of Co, and the balance of Fe, the range being inclusive of measurement errors. A Co-free magnet composition may be contemplated, and in this case, as a matter of course, neither the main phase nor the R'—(Fe,Co)—$M_1$' grain boundary phase contains Co. The R'—(Fe,Co)—$M_1$' grain boundary phase is distributed such that the main phase is covered with the grain boundary phase including an intergranular grain boundary phase, whereby adjacent main phases are magnetically divided, leading to an improvement in coercivity.

It is believed that the R'—(Fe,Co)—$M_1$' grain boundary phase is produced by peritectic reaction of $R_2(Fe,Co)_{14}B$ phase as main phase with R'—$M_1$" that becomes liquid phase at high temperature. That is, R'—(Fe,Co)—$M_1$' forms a stable phase at or below the peritectic point. The peritectic point of R'—(Fe,Co)—$N_1$' varies with the type of additive element $M_1$'. In the event R'=100% Nd, for example, the peritectic point is 640° C. for $M_1$'=Cu, 750 to 820° C. for $M_1$'=Al, 850° C. for $M_1$'=Ga, 890° C. for $M_1$'=Si, and 1080° C. for $M_1$'=Sn.

In the R'—(Fe,Co)—$M_1$' grain boundary phase, R' preferably contains at least 5 at % of Pr. In general, Pr is added from the standpoint of coercivity improvement, that is, for improving the anisotropic magnetic field of $R_2Fe_{14}B$ compound main phase, but it functions to reduce a temperature coefficient (β%/° C.) of coercivity, suggesting a reduced coercivity at high temperature. In the R'—(Fe,Co)—$M_1$' phase of the inventive magnet, however, Pr forms a more stable phase than Nd, suggesting that the Pr concentration in the R'—(Fe,Co)—$M_1$' phase is higher than that in the main phase, and the Pr content in the $R_2(Fe,Co)_{14}B$ main phase is relatively reduced. This compositional distribution of Pr contributes to an improvement in coercivity at room temperature and maintenance of such high coercivity even at high temperature. Because of the increased Pr content in R'—(Fe,Co)—$M_1$', the peritectic point of R'—(Fe,Co)—$M_1$' phase is lowered, suggesting that the conditions under which R'—(Fe,Co)—$M_1$' phase precipitates out to cover the main phase are mitigated. In the event R'-78 at % Nd+22 at % Pr, for example, the peritectic point is 810° C. for $M_1$'=Ga.

The R'—(Fe,Co)—$M_1$' phase preferably has a phase width of at least 50 nm on the average when it is distributed at the intergranular grain boundary. The phase average width is more preferably 50 to 500 nm, and even more preferably 100 to 500 nm. If the phase average width is less than 50 nm, a sufficient coercivity enhancing effect due to magnetic division is not obtainable.

The R'—(Fe,Co)—$M_1$' phase intervenes as an intergranular grain boundary phase between adjacent main phase grains and is present so as to cover the main phase to form a core/shell structure with the main phase. A percent coverage of the main phase with the R'—(Fe,Co)—$M_1$' grain boundary phase is at least 50% by volume, preferably at least 60% by volume, and more preferably at least 70% by volume, and the grain boundary phase may even cover overall the main phase. The balance of the intergranular grain boundary phase covering the main phase is R'—$M_1$" phase containing at least 50 at % of R'.

The R'—(Fe,Co)—$M_1$' phase is amorphous, nanocrystalline or amorphous/nanocrystalline while the R'—$M_1$" phase is amorphous or nanocrystalline. As used herein, the term "nanocrystalline" grains mean a collection of grains oriented in a plurality of directions in the electron irradiation radius range as observed under transmission electron microscope, with a grain size of approximately 10 nm or less; and the term "crystalline" grains are single crystal grains oriented in one direction in the electron irradiation radius range, with a grain size in excess of approximately 10 nm.

The magnet has an average crystal grain size of up to 6 μm, preferably 1.5 to 5.5 μm, and more preferably 2.0 to 5.0 μm, from the standpoint of coercivity enhancement, and the main phase preferably has a c-axis orientation of at least 98%. The average grain size is measured as follows. First, a section of sintered magnet is polished to mirror finish, immersed in an etchant such as vilella solution (mixture of glycerol:nitric acid:hydrochlorio acid=3:1:2) for selectively etching the grain boundary, and observed under a laser microscope. On analysis of the image, the cross-sectional area of individual grains is determined, from which the diameter of an equivalent circle is computed. Based on the data of area fraction of each grain size, the average grain size is determined. The average grain size of a sintered body may be controlled by reducing the average particle size of the magnet-forming alloy powder during fine milling.

The sintered magnet preferably has a percent magnetization of at least 96%, more preferably at least 97%. The magnetization is computed by standardizing a magnetic polarization at Pc=1 when a magnetic field of 640 kA/m is applied parallel to the direction of magnetic orientation from the thermally neutralized state, by a magnetic polarization at Pc=1 when a magnetic field of 1590 kA/m is applied parallel to the direction of magnetic orientation from the thermally neutralized state.

Method

Now the method for preparing an R—(Fe,Co)—B base sintered magnet having the above-defined structure is described. The method generally involves coarse grinding of a mother alloy, fine milling, compaction, and sintering.

The mother alloy is prepared by melting metal or alloy feeds in vacuum or an inert gas atmosphere, preferably argon atmosphere, and casting the melt into a flat mold or book mold or strip casting. Also applicable to the preparation of the mother alloy is a so-called binary alloy method involving individually preparing an mother alloy approximate to the $R_2$—$(Fe,Co)_{14}$—$B_1$ phase composition constituting the main phase and a sintering aid alloy with R-rich composition as liquid phase at sintering temperature, crushing, then weighing and mixing them. If there is a tendency of α-Fe being left behind depending on the cooling rate during casting, the cast alloy may be subjected to homogenizing treatment, if desired, for the purpose of increasing the amount of $R_2$—$(Fe,Co)_{14}$—$B_1$ phase. Specifically, the cast alloy is heat treated at 700 to 1,200° C. for at least one hour in vacuum or Ar atmosphere. To the sintering aid alloy, not only the casting technique mentioned above, but also the so-called melt quenching technique may be applied.

The alloy is first crushed or coarsely ground to a size of typically 0.05 to 3 mm, especially 0.05 to 1.5 mm. The crushing step generally uses a Brown mill or hydrogen decrepitation. For the alloy prepared by strip casting, hydrogen decrepitation is preferred. The coarse powder is then pulverized on a jet mill using high-pressure nitrogen gas, for example, to a size of typically 5 μm or less. An oxygen concentration may be controlled by reducing the oxygen concentration and the amount of moisture during fine milling. If desired, a lubricant or another additive may be added in any of crushing, mixing and fine milling steps.

The composition of the alloy is essentially of 12 to 17 at % of R which is at least two of yttrium and rare earth elements and essentially contains Nd and Pr, 0.1 to 3 at % of $M_1$ which is at least one element selected from the group consisting of Si, Al, Mn, Ni, Cu. Sn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Sr, Nb, Mo, Hf, Ta and W, 4.8+2×m to 5.9+2×m at % of B wherein m is atomic concentration of $M_2$, up to 10 at % of Co, and the balance of Fe.

The magnet-forming alloy powder as finely milled is compacted under an external magnetic field by a compression molding machine. The green compact is sintered in vacuum or in an inert gas atmosphere typically at a temperature of 900 to 1,250° C. preferably 1,000 to 1,150° C. for 0.5 to 5 hours.

In a first embodiment of the inventive method, the sintered magnet of the above-defined structure is prepared, after the step of sintering the compact as above, by cooling the resulting magnet to a temperature of 400° C. or below, preferably 300° C. or below, typically to room temperature. In this cooling step, the cooling rate is not particularly limited. Then the magnet is heated at a temperature in the range of 700 to 1,000° C. and not lower than the decomposition temperature ($T_d$° C.) of a compound consisting of the same components as the R'—(Fe,Co)—$M_1$' phase. In this heating step, the heating rate is preferably 1 to 20° C./min, more preferably 2 to 10° C./min, though not particularly limited. As alluded to previously, the decomposition temperature varies with the type of additive element M. The holding time at the temperature is preferably at least 1 hour, more preferably 1 to 10 hours, and even more preferably 1 to 5 hours. The heat treatment is preferably in vacuum or an inert gas atmosphere such as Ar gas.

After the high-temperature heat treatment, the magnet is cooled to a temperature of 400° C. or below, preferably 300° C. or below. The rate of cooling down to 400° C. or below is 5 to 100° C./min, preferably 5 to 80° C./min, and more preferably 5 to 50° C./min. At the end of cooling, the R'—(Fe,Co)—$M_1$' phase is eliminated to 1% by volume or less, and so the structure is mainly composed of $R_2(Fe,Co)_{14}B$ phase, R'—$M_1$" phase, R oxide phase, and $M_2$ boride phase, and may further contain R carbide phase, R nitride phase, R oxyfluoride phase, or mixed phase at the same time. If the cooling rate is less than 5° C./min, the R'—(Fe,Co)—$M_1$' phase precipitates in excess and largely segregates at the grain boundary triple junction, resulting in substantial degradation of magnetic properties. On the other hand, a cooling rate in excess of 100° C./min prevents the R'—(Fe,Co)—$M_1$' phase from precipitating during the cooling step, but allows the R'—$M_1$" phase to segregate at the grain boundary triple junction at the end of cooling. This negates that the subsequent low-temperature heat treatment causes the R'—(Fe,Co)—$M_1$' phase and R'—$M_1$" phase to continuously and uniformly precipitate and distribute as the intergranular grain boundary phase.

The high-temperature heat treatment is followed by low-temperature heat treatment including holding at a temperature in the range of 400 to 600° C. and not higher than the decomposition temperature ($T_d$° C.) of the R'—(Fe,Co)—$M_1$' phase and cooling to a temperature of 200° C. or below. The rate of heating at a temperature in the range of 400 to 600° C. is not particularly limited. This low-temperature heat treatment is preferably at a temperature of 400 to 600° C., more preferably 400 to 550° C. and even more preferably 450 to 550° C. for 1 to 50 hours, more preferably 1 to 20 hours, in vacuum or an inert gas atmosphere. By causing the R'—(Fe,Co)—$M_1$' grain boundary phase to precipitate from a low temperature not higher than the decomposition temperature ($T_d$° C.) of R'—(Fe,Co)—$M_1$' phase, the structure that the main phase is covered with the R'—(Fe,Co)—$M_1$' grain boundary phase is obtained. At a temperature below 400° C. the reaction rate is slow and impractical. At a temperature above 600° C. the reaction rate is fast, allowing the R'—(Fe,Co)—$M_1$' grain boundary phase to precipitate in excess and largely segregate at the grain boundary triple junction, resulting in substantial degradation of magnetic properties.

In a second embodiment of the inventive method, the sintered magnet of the above-defined structure is prepared, after the step of sintering the compact as above, by cooling the resulting magnet to a temperature of 400° C. or below, preferably 300° C. or below. In the second embodiment, the cooling rate of the cooling step is important. The rate of cooling down to 400° C. or below is 5 to 100° C./min, preferably 5 to 80° C./min, and more preferably 5 to 50° C./min. If the cooling rate is too slow or fast, there arises the same problem as discussed in conjunction with the cooling rate after high-temperature heat treatment in the first embodiment. By cooling the magnet to a temperature of 400° C. or below, the structure wherein the volume fraction of R'—(Fe,Co)—$M_1$' phase is up to 1% by volume is obtained.

The cooling step is followed by the same heat treatment as the low-temperature heat treatment in the first embodiment. The step is to hold at a temperature in the range of 400 to 600° C. and not higher than the decomposition temperature ($T_d$° C.) of the R'—(Fe,Co)—$M_1$' phase, for allowing the R'—(Fe,Co)—$M_1$' phase to precipitate. Since the procedure and conditions of this step are the same as the low-temperature heat treatment in the first embodiment, their description is omitted to avoid redundancy.

EXAMPLE

Examples are given below for further illustrating the invention although the invention is not limited thereto.

Examples 1 to 4 & Comparative Examples 1 to 3

A ribbon form alloy of 0.2-0.3 mm thick was prepared by the strip casting technique, specifically by using R metal (R is Nd and Pr or didymium), electrolytic iron, Co, other metals and ferroboron, weighing them so as to meet the desired composition, melting at high-frequency induction furnace in an Ar atmosphere, and casting the melt. The alloy was subjected to hydrogen decrepitation, that is, hydrogen absorption at normal temperature and subsequent heating at 600° C. in vacuum for hydrogen desorption. To the resulting alloy powder, 0.07 wt % of stearic acid as lubricant was added and mixed. The coarse powder was finely milled on a jet mill using nitrogen stream, into a fine powder having an average particle size of about 3 μm. In an inert gas atmosphere, a mold of a compacting machine was charged with the powder. While a magnetic field of 15 kOe was applied for orientation, the powder was compression molded in a direction perpendicular to the magnetic field. The compact was sintered in vacuum at 1050-1100° C. for 3 hours. The sintered magnet was cooled to 400° C. or below, followed by high-temperature heat treatment of holding at 900° C. for 1 hour, cooling to 200° C. low-temperature heat treatment for 2 hours, and cooling below 200° C.

Table 1 tabulates the composition of a magnet. Table 2 tabulates the cooling rate down to 200° C. after high-temperature heat treatment at 900° C., the temperature of low-temperature heat treatment, and magnetic properties and structure after low-temperature heat treatment.

Figure 2:
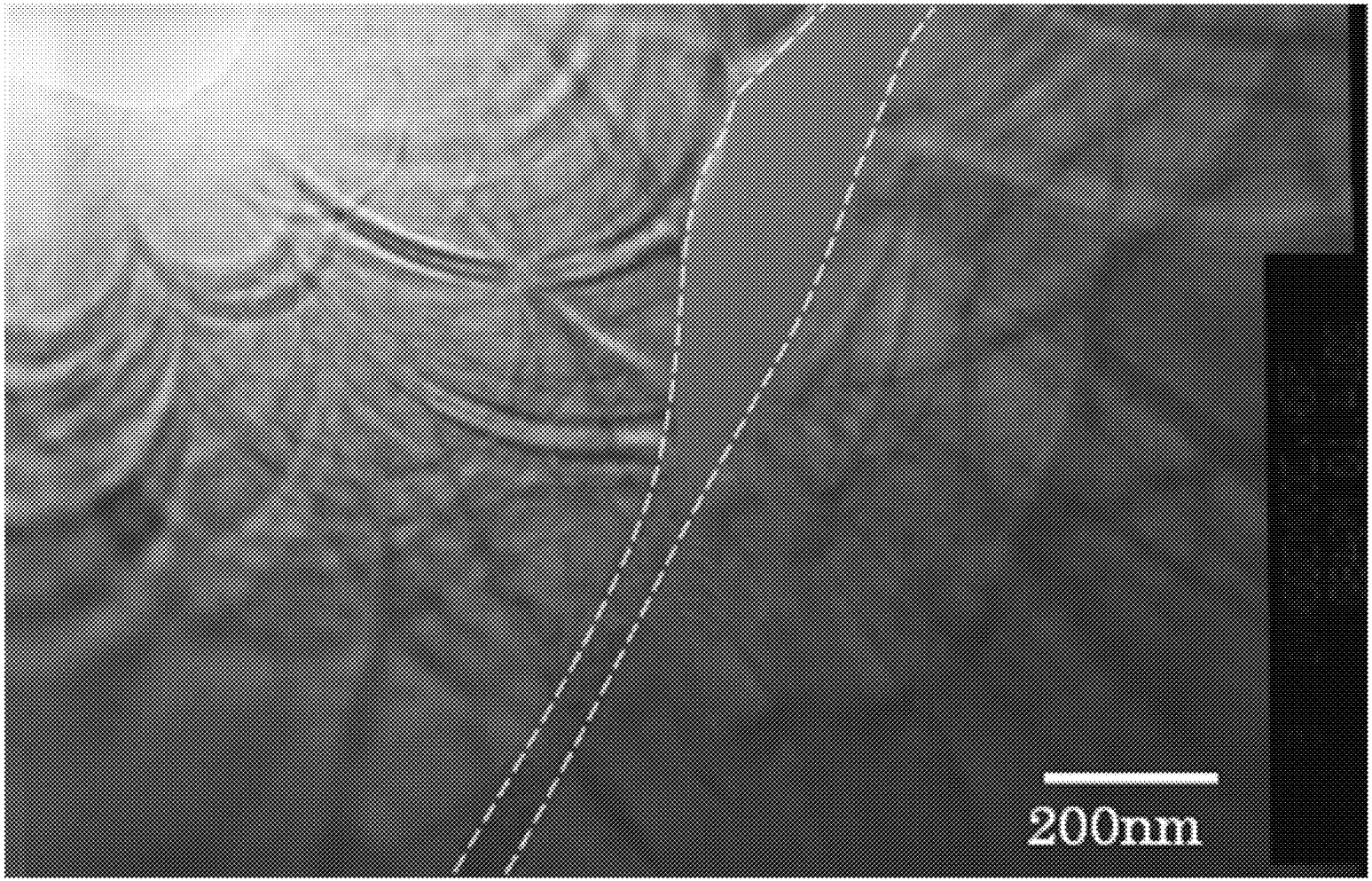
FIG. 2 is a TEM photomicrograph of a sintered magnet in Example 1, illustrating a grain boundary phase.

A cross section of each sintered magnet obtained in Example 1 was observed under an electron probe microanalyzer (EPMA). In FIG. 1, TRE stands for the amount of total rare earth in each sintered magnet, and Pr is more concentrated in black areas in FIG. 1. As shown in Example 1 of FIG. 1, the main phase is covered with a Pr-rich grain boundary phase. On observation of the structure of Example 1 under TEM, the grain boundary phase has a width of about 50 to 130 nm as shown in FIG. 2. Table 3 shows semi-quantitative values by EDX of R'—$M_1$" phase, R'—(Fe,Co)—$M_1$' phase and main phase in Examples 1 to 4 and Comparative Examples 1 to 3. In Examples 1 to 4, the R'—$M_1$" phase and R'—(Fe,Co)—$M_1$' phase have a higher Pr content than the main phase.

TABLE 1

| | | Nd (at %) | Pr (at %) | Dy (at %) | Fe (at %) | Co (at %) | B (at %) | Al (at %) | Cu (at %) | Zr (at %) | Si (at %) | Ga (at %) | Sn (at %) | O (at %) | N (at %) | C (at %) |
|---|---|---|---|---|---|---|---|---|---|---|---|---|---|---|---|---|
| Example | 1 | 11.6 | 3.4 | 0.0 | bal. | 0.5 | 5.4 | 0.2 | 0.5 | 0.07 | 0.10 | 0.70 | | 1.04 | 0.06 | 0.33 |
| | 2 | 7.5 | 7.5 | 0.0 | bal. | 0.5 | 5.4 | 0.2 | 0.2 | 0.07 | 0.10 | 0.70 | | 1.07 | 0.06 | 0.33 |
| | 3 | 10.0 | 5.5 | 0.0 | bal. | 0.5 | 5.4 | 0.2 | 0.2 | 0.07 | 0.20 | 0.60 | | 0.95 | 0.06 | 0.33 |
| | 4 | 11.6 | 3.4 | 0.0 | bal. | 0.5 | 5.3 | 0.2 | 0.2 | 0.07 | | 0.50 | 0.2 | 0.87 | 0.06 | 0.33 |
| Comparative | 1 | 15.0 | 0.0 | 0.0 | bal. | 0.5 | 5.4 | 0.2 | 0.2 | 0.07 | 0.30 | 0.50 | | 0.95 | 0.06 | 0.33 |
| Example | 2 | 14.0 | 1.0 | 0.0 | bal. | 0.5 | 5.4 | 0.2 | 0.2 | 0.07 | 0.20 | 0.60 | | 1.02 | 0.06 | 0.33 |
| | 3 | 11.6 | 3.4 | 0.0 | bal. | 0.5 | 5.4 | 0.4 | 0.5 | 0.10 | | 0.80 | | 1.04 | 0.06 | 0.33 |

TABLE 2

| | | Particle size (μm) | Cooling rate (° C./min) | Temp. of low-temp. heat treatment (° C.) | Br (kG) 23° C. | HcJ (kOe) 23° C. | HcJ (kOe) 120° C. | Average thickness of bi-granular grain boundary (nm) | Coverage (%) | R'—Fe(Co)—$M_1$' | R'—$M_1$" | $R_{1.1}Fe_4B_4$ | Average grain size (μm) |
|---|---|---|---|---|---|---|---|---|---|---|---|---|---|
| Example | 1 | 2.9 | 30 | 500 | 13.5 | 19.5 | 8.5 | 150 | 90 | A + F | F | no | 3.8 |
| | 2 | 2.8 | 30 | 450 | 13.3 | 22.0 | 10.2 | 180 | 85 | A + F | F | no | 3.6 |
| | 3 | 2.9 | 30 | 500 | 13.4 | 21.0 | 9.5 | 120 | 90 | A + F | F | no | 3.8 |
| | 4 | 3.0 | 30 | 500 | 13.3 | 19.0 | 8.2 | 200 | 85 | F | F | no | 3.9 |
| Comparative | 1 | 2.9 | 30 | 550 | 13.5 | 17.5 | 6.5 | 100 | 85 | A + F | F | no | 4.0 |
| Example | 2 | 2.9 | 30 | 500 | 13.3 | 18 | 6.8 | 120 | 90 | A + F | F | no | 3.9 |
| | 3 | 3.0 | 30 | 425 | 13.6 | 18 | 6.5 | 30 | 40 | A | F | no | 3.9 |

A: amorphous
F: nanocrystalline

TABLE 3

| | | Phase | Nd (at %) | Pr (at %) | Fe + Co (at %) | Si (at %) | Ga (at %) | Cu (at %) | Al (at %) | Sn (at %) |
|---|---|---|---|---|---|---|---|---|---|---|
| Example | 1 | R'—$M_1$" | 37.3 | 13.6 | 14.4 | 2.6 | 13.9 | 9.4 | 8.8 | |
| | | R'—Fe(Co)—$M_1$' | 19.0 | 6.1 | 67.5 | 1.3 | 4.4 | 1.2 | 0.5 | |
| | | Main phase | 14.2 | 3.4 | 82.4 | | | | | |
| | 2 | R'—$M_1$" | 27.0 | 36.6 | 4.4 | | 23.8 | 8.2 | | |
| | | R'—Fe(Co)—$M_1$' | 12.5 | 15.6 | 65.8 | 0.4 | 4.8 | 0.6 | 0.3 | |
| | | Main phase | 7.6 | 7.4 | 85.0 | | | | | |
| | 3 | R'—$M_1$" | 35.2 | 25.9 | 9.4 | | 11.2 | 11.2 | 7.1 | |
| | | R'—Fe(Co)—$M_1$' | 15.4 | 11.1 | 67.3 | 1.7 | 3.2 | 0.8 | 0.5 | |
| | | Main phase | 10.5 | 6.1 | 83.4 | | | | | |
| | 4 | R'—$M_1$" | 36.5 | 14.8 | 1.1 | | 6.1 | 39.1 | 2.4 | |
| | | R'—Fe(Co)—$M_1$' | 20.9 | 6.7 | 64.7 | | 5.1 | 0.6 | 0.1 | 1.9 |
| | | Main phase | 15.9 | 3.8 | 80.3 | | | | | |
| Comparative Example | 1 | R'—$M_1$" | 57.6 | | 5.3 | 4.8 | 12.2 | 11.2 | 3.1 | |
| | | R'—Fe(Co)—$M_1$' | 26.3 | | 66.4 | 1.8 | 3.7 | 0.9 | 0.7 | |
| | | Main phase | 16.3 | | 83.7 | | | | | |
| | 2 | R'—$M_1$" | 51.5 | 3.3 | 10.4 | 10.2 | 11.3 | 8.4 | 4.9 | |
| | | R'—Fe(Co)—$M_1$' | 26.0 | 1.7 | 64.6 | 1.3 | 3.5 | 0.5 | 2.3 | |
| | | Main phase | 18.3 | 1.2 | 80.5 | | | | | |
| | 3 | R'—$M_1$" | 47.5 | 12.6 | 14.6 | | 14.5 | 10.5 | | |
| | | R'—Fe(Co)—$M_1$' | 22 | 6 | 66.1 | | 4.8 | 0.8 | 0.3 | |
| | | Main phase | 13.6 | 3.8 | 82.6 | | | | | |

Japanese Patent Application No. 2015-225300 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. An R—(Fe,Co)—B base sintered magnet of a composition consisting essentially of 12 to 17 at % of R which is at least two of yttrium and rare earth elements and essentially contains Nd and Pr, 0.1 to 3 at % of $M_1$ which is at least one element selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta, and W, 4.8+2×m to 5.9+2×m at % of B wherein m is at % of $M_2$, up to 10 at % of Co, up to 0.5 at % of carbon, up to 1.5 at % of oxygen, up to 0.5 at % of nitrogen, and the balance of Fe, the R—(Fe,Co)—B base sintered magnet having a core/shell structure in which a main phase is covered with a grain boundary phase, containing $R_2(Fe,Co)_{14}B$ intermetallic compound as the main phase, a $M_2$ boride phase at a grain boundary triple junction, but not $R_{1.1}Fe_4B_4$ compound phase, and the grain boundary phase being composed of an amorphous and/or nanocrystalline R'—(Fe,Co)—$M_1$' phase consisting essentially of 25 to 35 at % of R' which consists of at least 5 at % of Pr and the balance of Nd and at least one of yttrium and rare earth elements, and contents of Pr in R' is higher than that of $R_2(Fe,Co)_{14}B$ intermetallic compound as a main phase, 2 to 8 at % of $M_1$' wherein $M_1$' is at least one element selected from the group consisting of Si, Al, Mn, Ni, Cu, Zn, Ga, Ge, Pd, Ag, Cd, In, Sn, Sb, Pt, Au, Hg, Pb, and Bi, up to 8 at % of Co, and the balance of Fe, or the R'—(Fe,Co)—$M_1$' phase and an amorphous and/or nanocrystalline R'—$M_1$" phase containing at least 50 at % of R' wherein $M_1$" is at least one element selected from the group consisting of Si, Al, Mn, Ni, Cu, Zn, Ga, Ge, Pd, Ag, Cd, In, Sn, Sb, Pt, Au, Hg, Pb, and Bi, a coverage of the main phase with the R'—(Fe,Co)—$M_1$' phase is at least 50% by volume, and the width of the grain boundary phase between two main phase grains is at least 50 nm on the average wherein the R—(Fe,Co)—B base sintered magnet and having a coercivity of at least 10 kOe at room temperature.

2. The sintered magnet of claim 1 wherein in the R'—(Fe,Co)—$M_1$' phase, $M_1$' consists of 0.5 to 50 at % of Si and the balance of at least one element selected from the group consisting of Al, Mn, Ni, Cu, Zn, Ga, Ge, Pd, Ag, Cd, In, Sn, Sb, Pt, Au, Hg, Pb, and Bi.

3. The sintered magnet of claim 1 wherein in the R'—(Fe,Co)—$M_1$' phase, $M_1$' consists of 1.0 to 80 at % of Ga and the balance of at least one element selected from the group consisting of Si, Al, Mn, Ni, Cu, Zn, Ge, Pd, Ag, Cd, In, Sn, Sb, Pt, Au, Hg, Pb, and Bi.

4. The sintered magnet of claim 1 wherein in the R'—(Fe,Co)—$M_1$' phase, $M_1$' consists of 0.5 to 50 at % of Al and the balance of at least one element selected from the group consisting of Si, Mn, Ni, Cu, Zn, Ga, Ge, Pd, Ag, Cd, In, Sn, Sb, Pt, Au, Hg, Pb, and Bi.

5. The sintered magnet of claim 1 wherein in the R'—(Fe,Co)—$M_1$' phase, $M_1$' consists of 0.5 to 50 at % of Cu and the balance of at least one element selected from the group consisting of Si, Al, Mn, Ni, Zn, Ga, Ge, Pd, Ag, Cd, In, Sn, Sb, Pt, Au, Hg, Pb, and Bi.

6. The sintered magnet of claim 1 wherein a total content of Dy and Tb is 0 to 5.0 at %.

7. A method for preparing the R—(Fe,Co)—B base sintered magnet of claim 1, comprising the steps of:

shaping a magnet-forming alloy powder into a compact, the alloy powder being obtained by finely milling an alloy consisting essentially of 12 to 17 at % of R which is at least two of yttrium and rare earth elements and essentially contains Nd and Pr, 0.1 to 3 at % of $M_1$ which is at least one element selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta and W, 4.8+2×m to 5.9+2×m at % of B wherein m is at % of $M_2$, up to 10 at % of Co, and the balance of Fe, and having an average particle size of up to 5.0 μm, sintering the compact at a temperature of 1,000 to 1,150° C., cooling the resulting magnet to a temperature of 400° C. or below, high-temperature heat treatment including heating the magnet at a temperature in the range of 700 to 1,000° C. and not lower than the decomposition temperature ($T_d$° C.) of a compound consisting of the same components as the R'—(Fe,Co)—$M_1$' phase, and cooling to a temperature of 400° C. or below at a rate of 5 to 100° C./min, and low-temperature heat treatment including holding at a temperature in the range of 400 to 600° C. and not higher than Td° C. for 1 minute to 20 hours, for allowing at least 80% by volume of the R'—(Fe,Co)—$M_1$' phase to precipitate in the magnet, and cooling to a temperature of 200° C. or below.

8. A method for preparing the R—(Fe,Co)—B base sintered magnet of claim 1, comprising the steps of:

shaping a magnet-forming alloy powder into a compact, the alloy powder being obtained by finely milling an alloy consisting essentially of 12 to 17 at % of R which is at least two of yttrium and rare earth elements and essentially contains Nd and Pr, 0.1 to 3 at % of $M_1$ which is at least one element selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta and W, 4.8+2×m to 5.9+2×m at % B wherein m is at % of $M_2$, up to 10 at % of Co, and the balance of Fe, and having an average particle size of up to 5.0 μm, sintering the compact at a temperature of 1,000 to 1,150° C., cooling the resulting magnet to a temperature of 400° C. or below at a rate of 5 to 100° C./min, and low-temperature heat treatment including holding at a temperature in the range of 400 to 600° C. and not higher than the decomposition temperature (Td° C.) of a compound consisting of the same components as the R'—(Fe,Co)—$M_1$' phase for 1 minute to 20 hours, for allowing at least 80% by volume of the R'—(Fe,Co)—$M_1$' phase to precipitate in the magnet, and cooling to a temperature of 200° C. or below.

9. The method of claim 7 wherein the alloy contains Dy and/or Tb in a total amount of 0 to 5.0 at %.

* * * * *